United States Patent [19]

Pollack

[11] Patent Number: 4,669,412

[45] Date of Patent: Jun. 2, 1987

[54] BOOM FOR SINGLE POINT MOORING SYSTEM

[75] Inventor: Jack Pollack, Reseda, Calif.

[73] Assignee: Amtel, Inc., Providence, R.I.

[21] Appl. No.: 233,048

[22] Filed: Feb. 10, 1981

[51] Int. Cl.[4] ..... B63B 22/02

[52] U.S. Cl. ..... 114/230; 441/4; 441/5

[58] Field of Search ..... 9/8 R, 8 P; 114/230, 114/125; 212/146, 147, 260; 141/387, 388; 14/28, 31-34, 36, 42, 71.3; 441/3, 4, 5

[56] References Cited

U.S. PATENT DOCUMENTS

| | | | |
|---|---|---|---|
| 1,266,029 | 5/1918 | Lehman | 244/78 |
| 2,882,536 | 4/1959 | Jordan | 9/8 P |
| 3,073,343 | 1/1963 | Mowell et al. | 141/387 |
| 3,426,719 | 2/1969 | Mizell | 114/230 |
| 3,442,245 | 5/1969 | Christians et al. | 114/230 |
| 3,479,673 | 11/1969 | Manning | 9/8 P |
| 3,500,484 | 3/1970 | Erzen | 114/230 |
| 3,783,816 | 1/1974 | Chassy et al. | 441/3 |
| 3,922,992 | 12/1975 | Wilbourn | 114/230 |
| 4,231,398 | 11/1980 | Gibbons | 114/230 |
| 4,262,380 | 4/1981 | Foolen | 9/8 P |

FOREIGN PATENT DOCUMENTS 2019800 11/1979 United Kingdom ..... 441/5

*Primary Examiner*—Joseph F. Peters, Jr.
*Assistant Examiner*—Thomas J. Brahan
*Attorney, Agent, or Firm*—Freilich, Hornbaker, Rosen & Fernandez

[57] ABSTRACT

A boom is described for use on a single point mooring system to connect a tower thereof to tankers or other vessels, wherein the boom is constructed to enable rapid attachment to a vessel and to protect boom components when not connected to a vessel. The boom has an inner end pivotally connected about a horizontal axis to a transfer structure, and has an outer end forming a compressible structure which can withstand compression and tension loads during coupling to a vessel. The boom end can be pulled up along the bow of a vessel until a secure connection can be made to the vessel, at a level at which a pipe connection at the end of the boom can connect to a pipe connector on the vessel. A buoyancy tank connected by a strut to an outer end portion of the boom holds the outer end of the boom at a considerable height above the water. Tanks lie on either side of the pivot axis of the boom, and a pump can be utilized to transfer water from one tank to the other to raise or lower the boom.

7 Claims, 8 Drawing Figures

FIG. 1
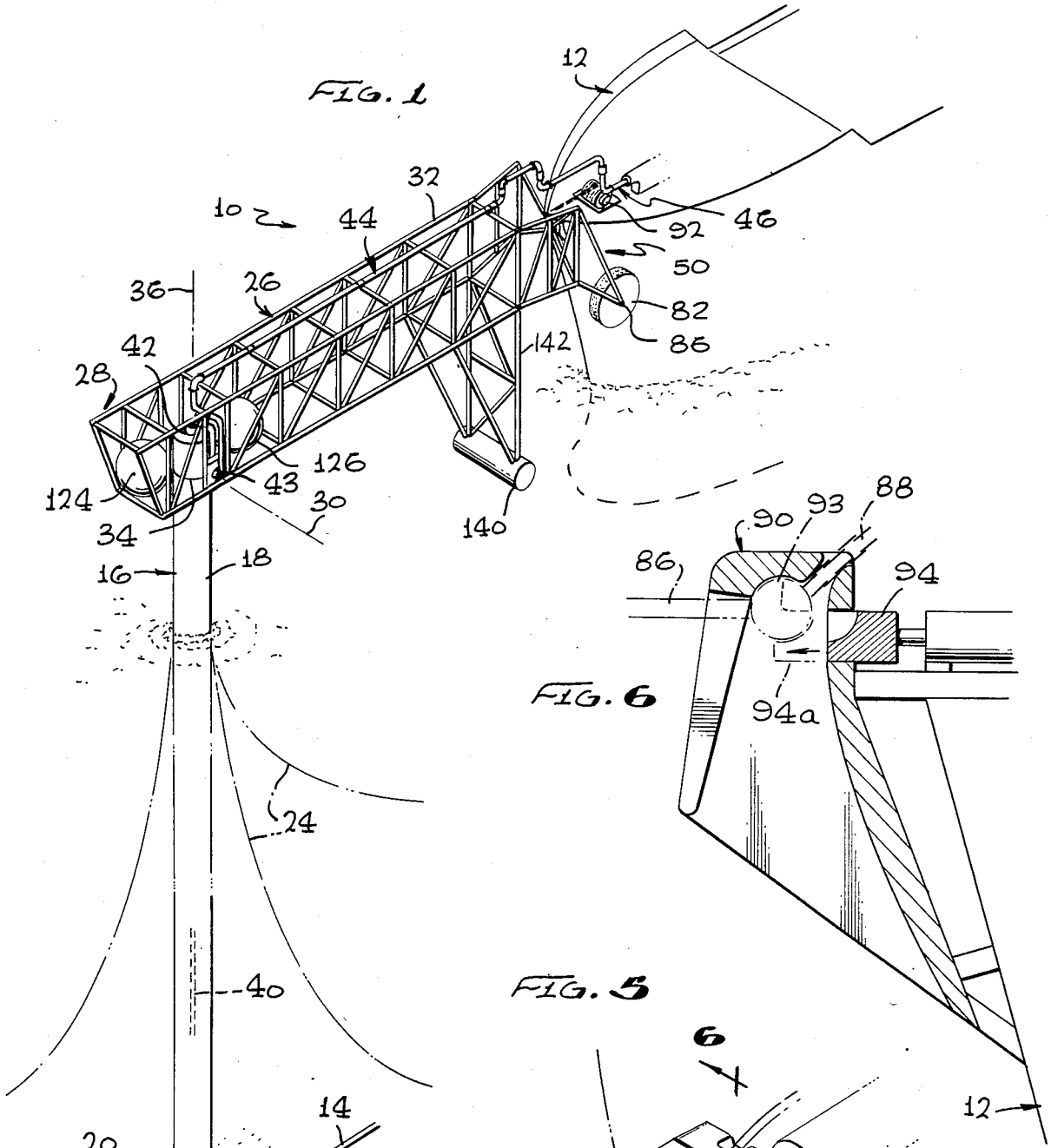
FIG. 6
FIG. 5
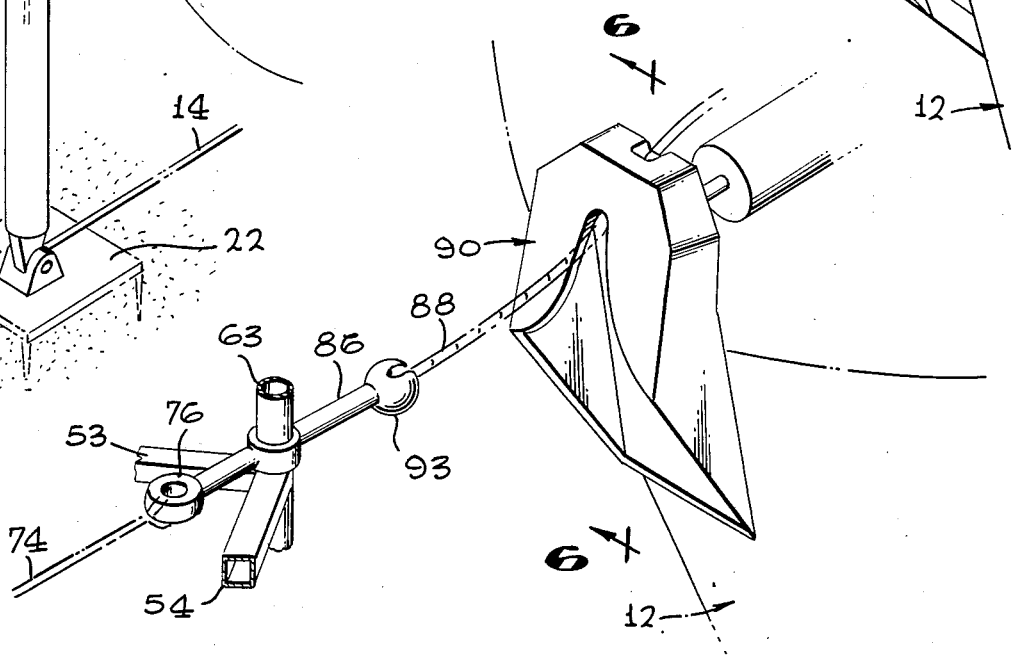

FIG. 2
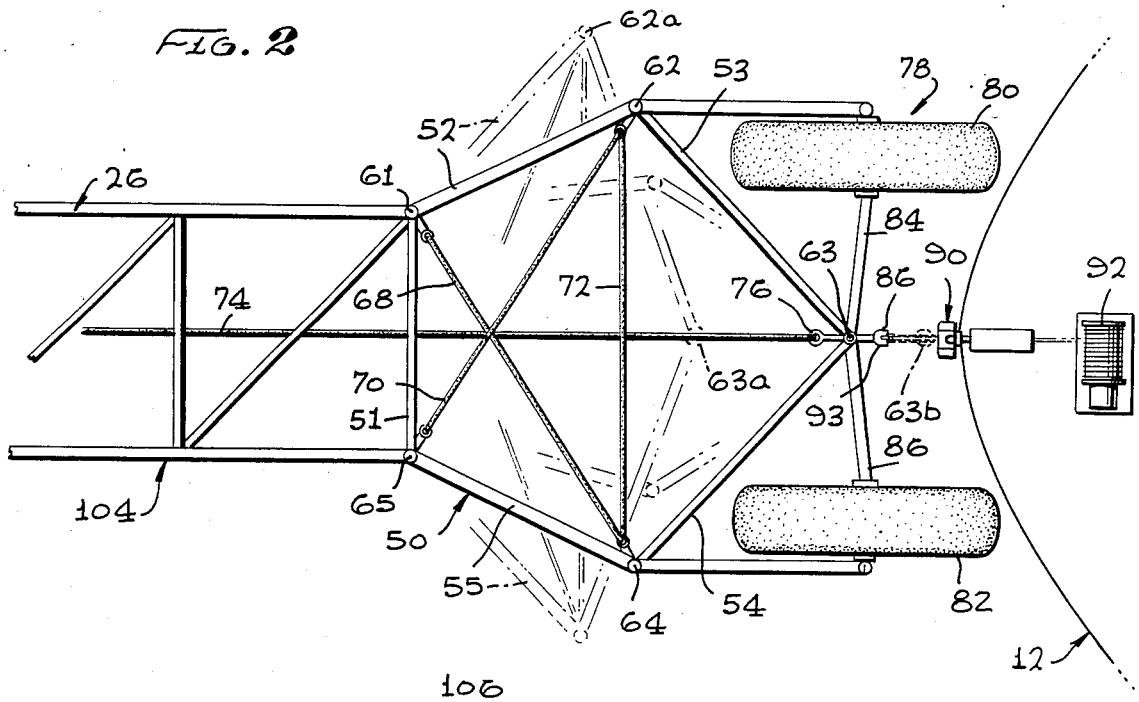
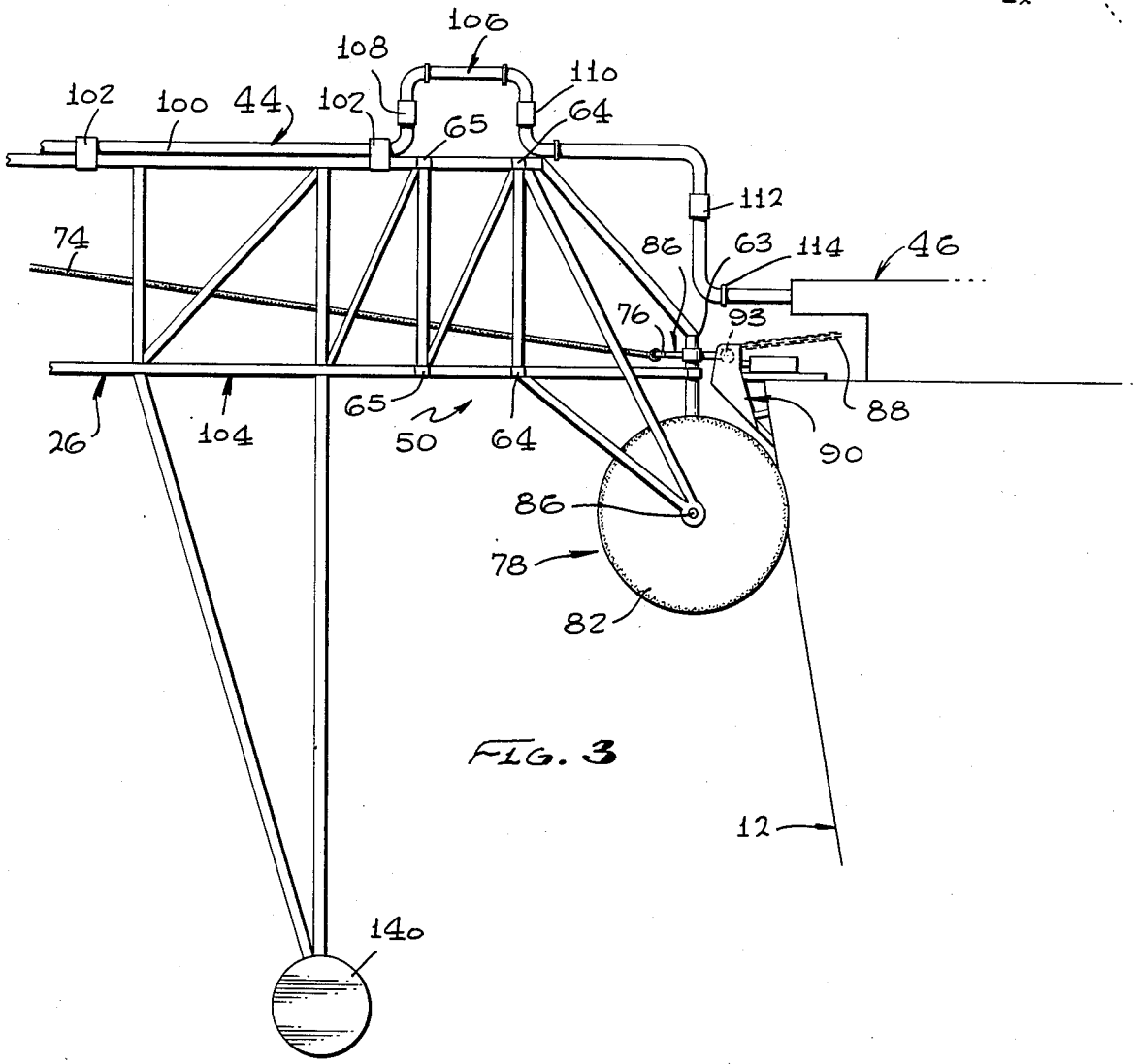
FIG. 3

FIG. 9
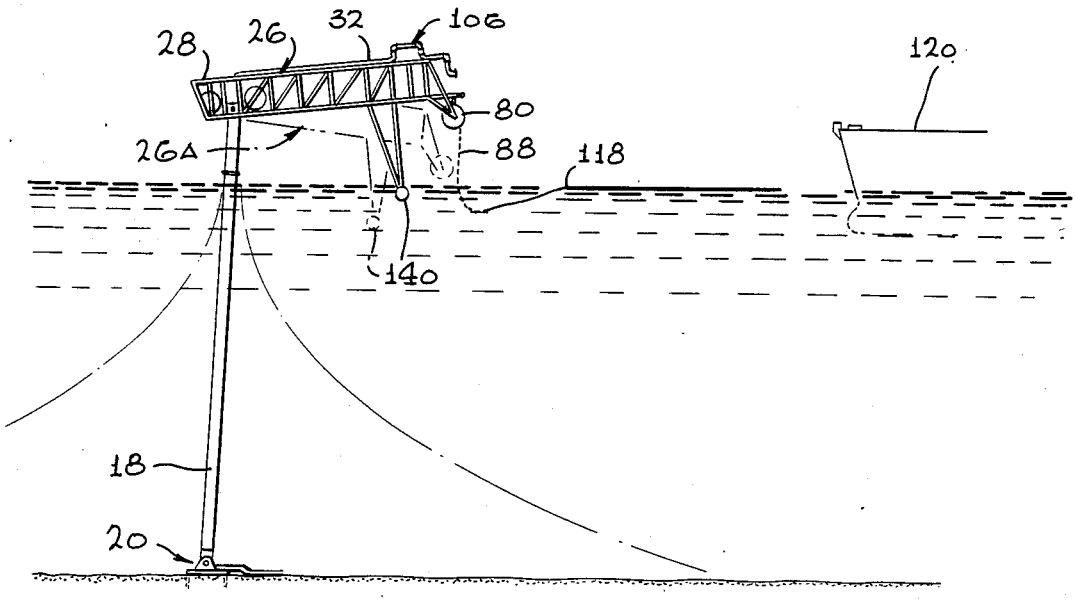
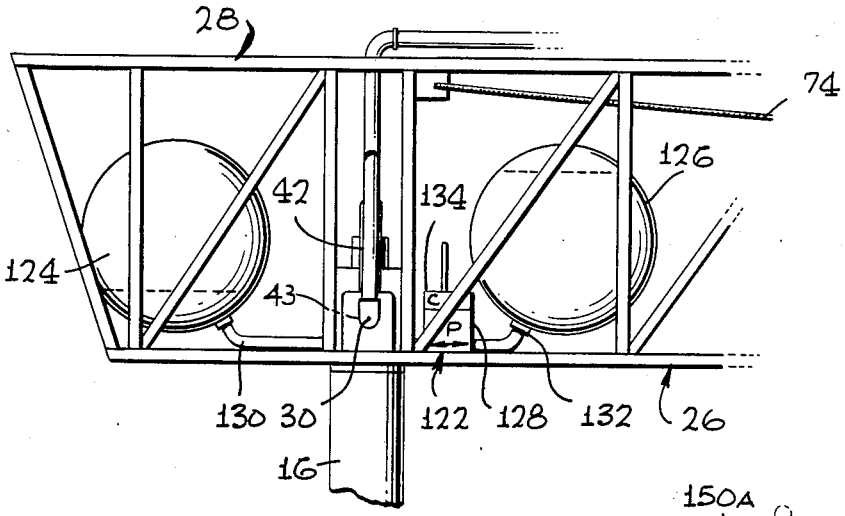
FIG. 7
FIG. 8
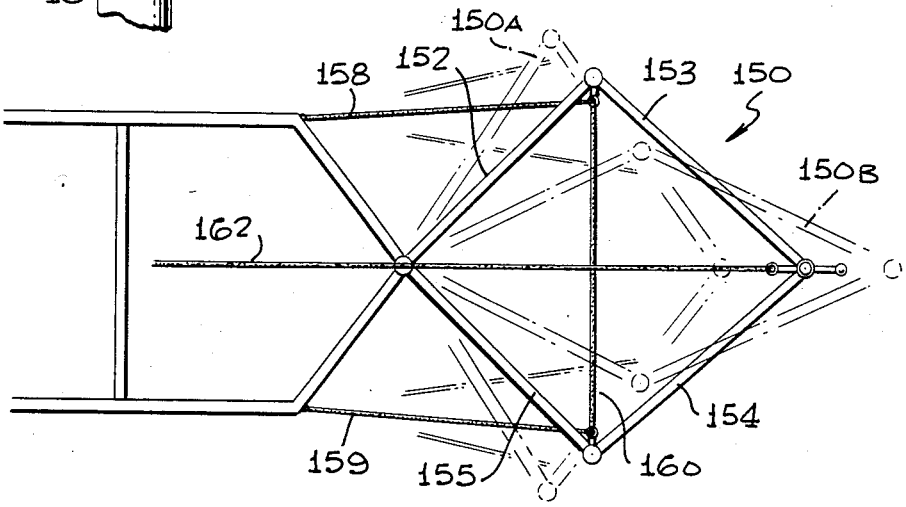

BOOM FOR SINGLE POINT MOORING SYSTEM

BACKGROUND OF THE INVENTION

Oil and other cargo can be transferred between an undersea pipeline (connected to undersea wells or a shore-based installation) and a tanker or other vessel, by the use of a single point mooring and cargo transfer system. Such a system can include a transfer structure, which may include a buoy anchored to the sea floor through several loose chains, or which may include a tower extending up from the sea floor to above the sea surface. A hawser can connect the transfer structure (buoy or tower) to the vessel, while a floating hose can extend from a fluid swivel on the transfer structure to the vessel to transfer a cargo such as oil between them. The use of a floating hose to transfer fluid from a transfer structure to a vessel is undesirable in many cases. For example, where LNG (liquified natural gas) is to be transferred, it is difficult to provide a flexible hose that can lie in the water, and which will have a reliable long lifetime. Even in the transference of oil, a floating hose structure is an expensive and high maintenance item.

The transference of fluid cargo between a transfer structure and a vessel can be effected by the use of a boom to support a rigid pipe or even a flexible hose above the water. However, the coupling of the end of a boom to a vessel is a delicate task, especially in areas of rough seas. A boom which could be connected to a vessel in a relatively short time, with minimal possibility of damage to the boom, and wherein the boom could resist damage in stormy weather when not connected to a vessel, would be of great value in the transport of hydrocarbons.

SUMMARY OF THE INVENTION

In accordance with one embodiment of the present invention, a single anchor point mooring and cargo transfer system is provided, which includes a boom extending from a transfer structure to couple to a vessel, wherein the boom is constructed to minimize damage thereto. The boom has an inner end portion pivotally mounted on a transfer structure to enable the boom to pivot about a horizontal axis as well as to rotate without limit about a vertical axis. The boom carries a pipe structure to enable the transfer of a fluid cargo to or from a vessel to which the outer end of the boom is connected. The boom has a major portion which is largely rigid along much of its length, and has a resiliently compressible structure at its outer end to absorb loads from a vessel. The pipe structure is attached at several points to the major boom portion, but includes a separate movable portion extending across the region occupied by the compressible boom structure.

One boom structure can be stored so its outer end extends at an upward incline to lie above the waves, by providing a mechanism to pump liquid between tanks on the boom lying on either side of the horizontal pivot axis so as to control tilt of the boom. The boom can be held in a stable, largely horizontal orientation, by the use of a buoyancy tank lying in the water below the boom and connected by struts to the boom. The boom can be tilted to lie slightly below the height of an approaching vessel, and can be raised slightly by a winch on the vessel to a level at which a pipe connector on the boom can readily connect to a corresponding pipe connector on the vessel. The compressible structure on the boom can be formed by links extending in a polygon that can be partially collapsed or extended, and by elastic lines connecting selected ends of the links to resiliently resist at least compression. A hawser can extend along the boom to resiliently resist elongation. Circular bumpers can be rotatably mounted at the outer end of the boom, to roll up along the side of a ship during adjustment of the boom to the height of the ship deck.

The novel features of the invention are set forth with particularity in the appended claims. The invention will best be understood from the following description when read in conjunction with the accompanying drawings.

BRIEF DESCRIPTION OF THE DRAWINGS

FIG. 1 is a perspective view of a single anchor point mooring and cargo transfer system constructed in accordance with the present invention.

FIG. 2 is a partial plan view of the boom of the system of FIG. 1.

FIG. 3 is a partial side elevation view of the boom of FIG. 2.

FIG. 4 is a side elevation view of the system of FIG. 1 shown prior to connection of a vessel.

FIG. 5 is a partial perspective view of the system of FIG. 1, shown during connection of the boom to a vessel.

FIG. 6 is a view taken on the line 6—6 of FIG. 5.

FIG. 7 is a partial side elevation view of the system of FIG. 1, showing apparatus for adjusting the pivotal position of the boom.

FIG. 8 is a partial plan view of a boom constructured in accordance with another embodiment of the invention.

DESCRIPTION OF THE PREFERRED EMBODIMENT

FIG. 1 illustrates an offshore single anchor point mooring and cargo transfer system 10 which enables the mooring of a vessel such as a tanker 12 and the transference of a fluid cargo such as hydrocarbons between an undersea pipeline 14 and the tanker. The system includes a transfer structure 16 which is in the form of a tower 18 having a lower end connected through a tilt joint 20 to a base 22 at the sea floor. The tower is biased towards a vertical orientation by buoyancy tanks therein and by several catenary chains 24 extending in loose curves from an upper portion of the tower to spaced locations at the sea floor. A boom 26 has an inner end portion 28 pivotally mounted about a largely horizontal axis 30 to the upper portion of the tower, and has an outer end portion 32 which is connected to the bow of the tanker 12. The tower has an upper end portion 34 which is mounted on heavy duty bearings to permit it to rotate without limit about a largely vertical axis 36, to permit the boom to also rotate thereabout so as to allow it to drift with the tanker under the influence of winds, waves, and currents.

Where fluid is to be transferred from the undersea pipeline 14 to the tanker 12, such fluid can pass from the pipeline through a fluid joint formed at the tilt joint 20, up through a pipe 40 extending through the tower, and to a fluid swivel 42 at the top of the tower. The fluid swivel 42 is connected through another fluid swivel 43, to a pipe structure 44 that extends along the boom, and that can connect to a fluid connector 46 on the tanker. The boom 26 therefore serves to moor the tanker 12 at substantially a fixed distance from the tower 16, and also to support the pipe structure 44 above the water and enable a pipe structure of limited length to be utilized. Such a pipe structure can include substantially only hard pipes and fluid swivels, which is especially useful where difficult cargo such as LNG is to be carried. Even where flexible hoses are to be used, the boom protects the hoses and allows hoses of limited length to be used.

One problem that is encountered in the use of a boom of substantially fixed length to connect a transfer structure to a vessel, is that the boom must withstand forces of the vessel in surging towards the transfer structure 16, as well as in tending to drift away. The transfer structure 16 can move towards and away from the vessel, but it moves slowly and cannot accommodate the rapid application of forces that may be caused by the action of waves on the vessel or forces encountered when the vessel is brought against the end of the boom. It is possible to transfer such forces by the use of heavy duty yokes connected by strong bearings at its opposite ends to the transfer structure and to the vessel. However, while such strong connections can be readily made where a vessel is to be permanently moored, it is much more difficult to provide such strong connections where vessels repeatedly connect to and disengage from the boom, and where it is desirable to provide minimum special adaption equipment on the vessel to engage the boom.

In accordance with an aspect of the present invention, the boom 26 is constructed so that relatively light duty connections can be utilized to couple it to the vessel and to the tower 16. The boom 26 is constructed with a resiliently flexible structure 50 at its outer end, which can withstand compressive loading applied by the tanker 12 as it moves towards the boom during connection thereto. As shown in FIG. 2, the flexible structure 50 includes five links 51–55 pivotally connected to one another at their ends to form a pentagon. The pivotal connections 61–65 at the ends of the links allows the pentagon to collapse and expand. However, collapsing is resisted by the use of three elastic lines 68, 70, and 72 which connect spaced locations on the pentagon structure that move apart as the structure collapses. For example, when the outermost pivot 63 moves inward to the location 63*a*, the pivot 62 moves to position 62*a* which causes the line 70 to be pulled tighter as well as causing the other two lines to be pulled tighter to elastically resist such collapse. On the other hand, when the pivot 63 is pulled outwardly to the position 63*b*, to expand the structure all of the elastic lines 68, 70, and 72 can contract in length, and can even be allowed to become slack if not under an initial high pretension. The structure 50 includes another set of five links at its lower end.

The flexible structure 50 is made to resist expansion, by the use of an elastic line or hawser 74 which extends along most of the length of the boom, and which is connected to an eyelet 76 on the outer pivot 63 of the collapsible structure. Since the major loading of a moored tanker is in tension, the hawser resists elongation more strongly than the collapsible structure resists compression.

During the initial mooring operation, the tanker 12 may make contact with the flexible structure 50. In order to avoid damage and to transfer loads from the tanker 12 to the flexible structure, a bumper structure 78 is mounted on the flexible structure. The bumper structure 78 includes a pair of circular boat bumpers 80, 82 that are rotatably mounted on axles 84, 86 that are connected to the flexible structure. Of course, the bumpers 80, 82 can transfer only compressive loading to the boom. Tension loading, as well as compressive loading, can be transferred from the vessel to the boom through a hitch 86 which extends from the outermost pivot 63. As shown in FIG. 5, a chain 88 extends from the hitch 86 past a lock device 90 on the tanker 12 to a winch 92 on the tanker. The winch 92 can be operated to pull the chain 88, so as to pull the ball 93 on the hitch upwardly and closer to the vessel, until it is fully received in the lock device, as shown in FIG. 6. A latch 94 of the lock device then can be moved foward by a hydraulic ram to position 94*a*, to securely hold the hitch to the vessel. Thereafter, both tension and compression forces can be transferred from the vessel through the hitch 86 to the boom. The shock of any sudden loading in tension or compression, is absorbed respectively by the hawser 74 and the flexbile compressible structure 50 of the boom. If, during calm conditions, the tanker should surge toward the tower and begin to swing out of line with the boom, the bumpers 80, 82 will contact the tanker 12 and resist considerable misalignment. Thus, the bumpers, 80,82 serve as a means for resisting pivoting of the flexible structure outer end relative to the vessel about a vertical axis. The flexible structure is connected at the laterally spaced locations 61 and 65 to the major stiff boom portion 104, to prevent free rotation of the link 51 and the flexible structure relative to the stiff boom portion 104 about a vertical axis.

As shown in FIG. 3, the pipe structure 44 which is located on the boom, includes a first portion 100 in the form of a rigid pipe. The pipe 100 is attached several locations 102 to the major boom portion 104; the major portion 104 extends from the inner boom end portion and that is connected to the tower, and from there to the flexible structure 50. The pipe structure also includes a movable portion 106 which includes three fluid swivels 108, 110, and 112 and connecting pipe sections, to enable movement of a pipe coupling 114 at the outer end thereof so as to connect to the ship board pipe connector 46. The movable pipe structure 106 can flex somewhat so as to accommodate compression and elongation of the flexible structure 50 of the boom, but is free of direct attachment to the collapsible structures 50 of the boom so that none of the mooring forces passes through the movable pipe structure portion 106.

FIG. 4 shows the boom 26 in a stored position wherein its outer end extends at an upward incline from the inner end, so that the movable pipe structure 106 is above the water. The chain 88 hangs down from the outer end of the boom, and a messenger line 118 is tied to the end of the chain. An approaching vessel 120 can pick up the messenger line 118 while it sails slowly towards the boom 26. The boom can be lowered, as to the position 26A before it is to engage the vessel, so that the bumpers such as 80 lie below the deck of the approaching vessel. The vessel may be finally brought to the end of the boom by operating the winch 92 (FIG. 2) on the vessel to slowly draw it against the end of the boom to raise it to the exact height required to engage the lock device 90. During initial raising of the boom, the rotatable bumpers such as 80 can roll up along the side of the ship. However, the hitch 86 is depended upon to transfer loads after it is connected to the vessel. After the hitch 86 is locked to the ship, the movable pipe structure at the outer end of the boom can be moved to connect it to the pipe connection on the ship, and fluid transfer can begin.

The tilt angle of the boom 26 can be adjusted by the use of a tilt control apparatus 122 shown in FIG. 7. The apparatus includes a pair of tanks 124, 126 mounted on the boom at locations on opposite sides of the horizontal tilt axis 30 of the boom on the tower. A pump 128 of the control apparatus is connected through pipes 130, 132 to the two tanks, to pump a liquid such as water or an antifreeze solution, from one tank to the other. A controller 134 which may be radio controlled and which may carry electrical cells to power the pump 128, operates the pump to pump liquid in the desired direction. For example, if it is desired to tilt down the outer end of the boom to the height of a small vessel, the pump 128 is operated to pump water from the tank into the tank 126. The pumping of liquid into the tank 126 not only increases the weight of the tank 126, but also decreases the weight of the tank 124. The height of the outer end of the boom above the ocean surface, is stabilized by a buoyancy tank 140 (FIG. 1) which is connected by buoyant struts 142 to the outer end of the main boom portion which lies immediately inside the collapsible structure 50 of the boom. The struts 142 have large diameters and are also sealed against the entrance of sea water, so that as they are immersed progressively deeper, they apply a progressively greater buoyancy to the boom to stabilize its orientation. In fact, the struts 142 are tubes that are positively buoyant.

While the polygon of FIG. 2, with five sides, or links, forming a flexible structure can be effective used, other polygon structures of four or more sides and of somewhat similar construction, also can be used. FIG. 8 shows a boom with a flexible structure 150 having four sides 152–155 which can be flexibly compressed as to 150A and flexibly elongated as to 150B. Three stretchable lines 158–160 resiliently resist compression of the structure (as well as resisting misalignment of it) while a hawser line 162 resiliently resists elongation of the structure.

Thus, the invention provides a single anchor point mooring and cargo transfer system which includes a boom extending from the transfer structure and rotatable about horizontal and vertical axes on the transfer structure, wherein the boom can be easily connected to a vessel and can absorb both compression and tension forces that may be applied by the vessel, and with the boom carrying a pipe structure that is largely isolated from such mooring forces. This can be accomplished by utilizing a boom which is relatively rigid along most of its length, but which has a resilient structure at its outer portion which can absorb compressive forces applied thereto by a vessel. Tension forces can be resiliently resisted by a resilient hawser that can extend along a majority of the length of the boom. The pipe structure can include a relatively rigid pipe lying on the major boom portion and a movable pipe structure portion extending across the region occupied by the collapsible structure. The boom structure can lie slightly below the level of a vessel that approaches it, can absorb some of the shock that may be encountered during close connection to an end of the vessel, and can be pulled up along the vessel to the precise height at which the hitch on the boom can be securely fastened to a lock device on the vessel. The movable pipe portion then can be connected to a pipe connector on the vessel. An apparatus can be provided to adjust the tilt angle of the boom, so as to keep its outer end with the movable pipe structure thereon, away from waves in rough weather. The tilt adjust apparatus can include a pair of tanks located on either side of the horizontal pivot axis of the boom, and can also include a pump for pumping water or other liquid from one tank to the other.

Although particular embodiments of the invention have been described and illustrated herein, it is recognized that modifications and variations may readily occur to those skilled in the art and consequently, it is intended that the claims be interpreted to cover such modifications and equivalents.

What is claimed is:

1. In a single anchor point mooring and cargo transfer system which includes a transfer structure lying at the sea surface and anchored in approximate location, for mooring and transferring cargo with respect to a vessel, the improvement comprising:

a boom having an inner end portion pivotally mounted on said transfer structure to permit pivoting of the boom about a horizontal axis thereon, and having an outer end which is attachable to a vessel;

said boom having a flexible structure at its outer end which resiliently resists compression, said boom having a major boom portion more rigid than said flexible structure and extending from said inner end portion to said flexible structure and having a major portion outer end, said flexible structure having an inner structure end mounted on said major portion outer end and having an outer structure end which lies further from said horizontal axis than does the major portion outer end so the flexible structure itself undergoes compression when compression forces are applied along the length of the boom; and a pipe structure mounted on said boom to carry fluid cargo, said pipe structure including a first pipe structure portion attached to said major boom portion at a plurality of locations therealong, said pipe structure also having an extendable portion extending outward from said first pipe structure portion to pass across the region occupied by said flexible structure, said extendable portion being free of rigid attachment to said flexible structure.

2. The improvement described in claim 1 wherein:

said boom includes means mounted on the outer end of said flexible structure and which can couple to a vessel for resisting pivoting of said flexible structure outer end relative to the vessel about a vertical axis;

said major boom portion has opposite sides at its major boom outer end and said flexible structure has opposite sides, and including means coupling the opposite sides of said flexible structure to the opposite sides of said major boom portion for transferring torque about a vertical axis to said outer end of said major boom portion.

3. A single anchor point mooring system comprising:

a tower extending from near the sea floor to above the sea surface, and having a lower end pivotally connected to the sea floor to permit the tower to tilt from the vertical; and an elongated boom pivotally mounted about a substantially horizontal axis on the upper portion of said tower, said boom having a rigid boom portion extending from said horizontal axis, and said boom having a flexible structure which is aligned with said rigid boom portion and which is elastically compressible, connected to the end of said rigid portion opposite said horizontal axis to prevent free rotation of said flexible structure relative to said rigid boom portion about a vertical axis, and said boom having means at an end of said tower for coupling to the vessel.

4. The system described in claim 3 including:

a fluid conduit extending from the sea floor, up along said tower, and along said boom to the second end portion thereof;

said conduit including a substantially rigid pipe extending along said rigid portion of said boom, and a moveable pipe structure which is extensible and collapsible, extending beyond said rigid pipe to cross the region occupied by said flexible structure, said moveable pipe structure being free of rigid connection to said flexible boom structure;

said moveable pipe structure including at least two horizontally spaced fluid swivels oriented with their swivel axes substantially vertical, and a pair of substantially rigid pipes connecting pairs of said fluid swivels.

5. In a single anchor point mooring and cargo transfer system which includes a transfer structure lying at the sea surface and anchored in approximate location for mooring and transferring cargo with respect to a vessel, the improvement comprising:

a boom pivotally mounted about a substantially horizontal axis on said transfer structure, and having first and second opposite portions lying on opposite sides of said horizontal axis, said boom having an outer end on the same side of said axis as said second portion and having coupling means at said outer end for direct attachment to a vessel;

a float lying below said boom and only partially submerged in the sea, said float being fastened to said boom at a location between said horizontal axis and the outer end of the boom, to support said outer end so it can lie above the sea surface; and means for shifting weight between said first and second boom portions in amounts that vary the weight on said float and therefore its depth of submersion while continually maintaining said float at least partially submerged, to pivot said boom so as to alter the height of said coupling means.

6. In a single anchor point mooring and cargo transfer system which includes a transfer structure lying at the sea surface and anchored in approximate location for mooring and transferring cargo with respect to a vessel, the improvement comprising:

a boom pivotally mounted about a substantially horizontal axis on said transfer structure, said boom having first and second opposite portions lying on opposite sides of said horizontal axis, said boom having a pair of tanks on opposite sides of said horizontal axis, and said boom having an outer end on the same side of said axis as said second portion and having coupling means at said outer end for attachment to a vessel;

a float lying below said boom and fastened thereto at a location between said horizontal axis and the outer end of the boom, to support said outer end so it can lie above the sea surface; and pump means for flowing liquid from one of said tanks to the other to vary the weight on said float and therefore its depth of submersion while continually maintaining said float at least partially submerged, to pivot said boom so as to alter the height of said coupling means.

7. A single anchor point mooring system comprising:

a tower extending from near the sea floor to above the sea surface, and having a lower end pivotally connected to the sea floor to permit the tower to tilt from the vertical; and an elongated boom pivotally mounted about a substantially horizontal axis on the upper portion of said tower, said boom having a rigid boom portion extending from said horizontal axis, and said boom having a flexible structure which is aligned with said rigid boom portion and which is elastically compressible, connected to the end of said rigid portion which is opposite said horizontal axis to prevent free rotation of said flexible structure relative to said rigid boom portion about a vertical axis, and said boom having means at an end of said flexible structure for coupling to the vessel;

said flexible structure includes at least five links, with adjacent ends of pairs of the links pivotally connected to permit collapse of the structure, and means resiliently resisting such collapse, one of said links connected to at least two laterally spaced locations of said rigid boom portion to prevent rotation of said one link about a vertical axis.

* * * * *